US011265664B2

(12) United States Patent
Shennib

(10) Patent No.: US 11,265,664 B2
(45) Date of Patent: Mar. 1, 2022

(54) WIRELESS HEARING DEVICE FOR TRACKING ACTIVITY AND EMERGENCY EVENTS

(71) Applicant: K/S HIMPP, Lynge (DK)

(72) Inventor: Adnan Shennib, Oakland, CA (US)

(73) Assignee: K/S HIMPP, Lynge (DK)

( * ) Notice: Subject to any disclaimer, the term of this patent is extended or adjusted under 35 U.S.C. 154(b) by 0 days.

(21) Appl. No.: 16/813,472

(22) Filed: Mar. 9, 2020

(65) Prior Publication Data

US 2020/0213783 A1 Jul. 2, 2020

Related U.S. Application Data

(63) Continuation of application No. 15/669,747, filed on Aug. 4, 2017, now Pat. No. 10,587,964, which is a (Continued)

(51) Int. Cl.
*H04R 25/00* (2006.01)

(52) U.S. Cl.
CPC ..... *H04R 25/554* (2013.01); *H04R 25/558* (2013.01); *H04R 25/552* (2013.01); (Continued)

(58) Field of Classification Search
CPC .. H04R 25/554; H04R 25/558; H04R 25/552; H04R 2225/55; H04R 2225/61
(Continued)

(56) References Cited

U.S. PATENT DOCUMENTS 3,659,056 A 4/1972 Morrison et al.
4,628,907 A 12/1986 Epley
(Continued)

FOREIGN PATENT DOCUMENTS

KR 100955033 4/2010
KR 1020100042370 4/2010
(Continued)

OTHER PUBLICATIONS

"Lyric User Guide", http://www.phonak.com/content/dam/phonak/b2b/C_M_tools/Hearing_Instruments/Lyric/documents/02-GB/Userguide_Lyric_V8_GB_Final_WEB.pdf, Jul. 2010.
(Continued)

*Primary Examiner* — Phylesha Dabney
(74) *Attorney, Agent, or Firm* — Dorsey & Whitney LLP

(57) ABSTRACT

The present disclosure describes examples of systems and methods of wireless remote control of appliances and medical devices using a canal hearing device upon manual activation of a switch placed in the concha cavity behind the tragus. The manual activation of the switch may be by applying a force to the tragus by a finger of a user of the canal hearing device. In one embodiment the lateral end comprises one or more manually activated switches, a wireless antenna, and a battery cell. In some examples, the wireless electronics include low energy Bluetooth. The appliance may be any device with wireless capabilities, for example an electronic lock, a thermostat, an electronic lighting, a telephone, a kitchen appliance, a medical alert system, a television, a medical device, and a smart glass. The inconspicuous and secure wear of the hearing device allows for active lifestyle, including exercise, and more discrete communications.

21 Claims, 14 Drawing Sheets

Related U.S. Application Data continuation of application No. 14/832,751, filed on Aug. 21, 2015, now Pat. No. 9,769,577.

(60) Provisional application No. 62/041,001, filed on Aug. 22, 2014.

(52) U.S. Cl.
CPC ..... *H04R 25/603* (2019.05); *H04R 2225/55* (2013.01); *H04R 2225/61* (2013.01)

(58) Field of Classification Search
USPC ..... 381/315
See application file for complete search history.

(56) References Cited

U.S. PATENT DOCUMENTS 4,759,070 A 7/1988 Voroba
4,817,607 A 4/1989 Tatge
5,003,608 A 3/1991 Carlson
5,197,332 A 3/1993 Shennib
5,327,500 A 7/1994 Campbell
5,425,104 A 6/1995 Shennib
5,553,152 A 9/1996 Newton
5,603,726 A 2/1997 Schulman et al.
5,610,988 A 3/1997 Miyahara
5,615,229 A 3/1997 Sharma et al.
5,645,074 A 7/1997 Shennib et al.
5,659,621 A 8/1997 Newton
5,701,348 A 12/1997 Shennib et al.
5,721,783 A 2/1998 Anderson
5,768,397 A 6/1998 Fazio
5,785,661 A 7/1998 Shennib et al.
6,021,207 A 2/2000 Puthuff et al.
6,137,889 A 10/2000 Shennib et al.
6,212,283 B1 4/2001 Fletcher et al.
6,319,207 B1 11/2001 Naidoo
6,359,993 B2 3/2002 Brimhall
6,367,578 B1 4/2002 Shoemaker
6,379,314 B1 4/2002 Horn
6,382,346 B2 5/2002 Brimhall et al.
6,428,485 B1 8/2002 Rho
6,447,461 B1 9/2002 Eldon
6,473,513 B1 10/2002 Shennib et al.
6,522,988 B1 2/2003 Hou
6,546,108 B1 4/2003 Shennib et al.
6,674,862 B1 1/2004 Magilen
6,694,034 B2 2/2004 Julstrom et al.
6,724,902 B1 4/2004 Shennib et al.
6,816,601 B2 11/2004 Lin et al.
6,840,908 B2 1/2005 Edwards et al.
6,937,735 B2 8/2005 DeRoo et al.
6,940,988 B1 9/2005 Shennib et al.
6,940,989 B1 9/2005 Shennib et al.
6,978,155 B2 12/2005 Berg
7,010,137 B1 3/2006 Leedom et al.
7,016,511 B1 3/2006 Shennib
7,037,274 B2 5/2006 Thoraton et al.
7,113,611 B2 9/2006 Leedom et al.
7,164,775 B2 1/2007 Meyer et al.
7,181,032 B2 2/2007 Jakob et al.
7,215,789 B2 5/2007 Shennib et al.
7,221,769 B1 5/2007 Jorgensen
7,227,968 B2 6/2007 van Halteren et al.
7,260,232 B2 8/2007 Shennib
7,266,208 B2 9/2007 Charvin et al.
7,298,857 B2 11/2007 Shennib et al.
7,310,426 B2 12/2007 Shennib et al.
7,321,663 B2 1/2008 Olsen
7,330,101 B2 2/2008 Sekura
7,403,629 B1 7/2008 Aceti et al.
7,421,087 B2 9/2008 Perkins et al.
7,424,123 B2 9/2008 Shennib et al.
7,424,124 B2 9/2008 Shennib et al.
7,512,383 B2 3/2009 Essabar et al.
7,580,537 B2 8/2009 Urso et al.
7,664,282 B2 2/2010 Urso et al.
7,720,242 B2 5/2010 Anderson et al.
7,751,578 B2 7/2010 Arz et al.
7,854,704 B2 12/2010 Givens et al.
7,945,065 B2 5/2011 Menzl et al.
8,036,405 B2 10/2011 Ludvigsen et al.
8,073,170 B2 12/2011 Kondo et al.
8,077,890 B2 12/2011 Schumaier
8,116,494 B2 2/2012 Rass et al.
8,155,361 B2 4/2012 Schindler
8,175,306 B2 5/2012 Meskens et al.
8,184,842 B2 5/2012 Howard et al.
8,243,972 B2 8/2012 Latzel
8,284,968 B2 10/2012 Schumaier
8,287,462 B2 10/2012 Givens et al.
8,340,335 B1 12/2012 Shennib
8,379,871 B2 2/2013 Michael et al.
8,396,237 B2 3/2013 Schumaier
8,447,042 B2 5/2013 Gurin
8,467,556 B2 6/2013 Shennib et al.
8,503,703 B2 8/2013 Eaton
8,571,247 B1 10/2013 Oezer
8,718,306 B2 5/2014 Gommel et al.
8,767,986 B1 7/2014 Fabry et al.
8,798,301 B2 8/2014 Shennib
8,855,345 B2 10/2014 Shennib et al.
8,867,768 B2 10/2014 Contioso et al.
9,002,046 B2 4/2015 Jones et al.
9,060,233 B2 6/2015 Shennib et al.
9,559,544 B2 1/2017 Jakubowski
9,769,577 B2 * 9/2017 Shennib ..... H04R 25/558
9,805,590 B2 10/2017 Shennib
10,097,933 B2 10/2018 Shennib
10,242,565 B2 3/2019 Shennib
10,587,964 B2 3/2020 Shennib
2001/0008560 A1 7/2001 Stonikas et al.
2002/0027996 A1 3/2002 Leedom et al.
2002/0054689 A1 5/2002 Zhang et al.
2002/0085728 A1 7/2002 Shennib et al.
2003/0007647 A1 1/2003 Nielsen et al.
2003/0137277 A1 7/2003 Mori et al.
2004/0138723 A1 7/2004 Malick et al.
2004/0165742 A1 8/2004 Shennib et al.
2004/0234092 A1 11/2004 Wada et al.
2005/0190938 A1 9/2005 Shennib et al.
2005/0245991 A1 11/2005 Faltys et al.
2005/0249370 A1 11/2005 Shennib et al.
2005/0259840 A1 11/2005 Gable et al.
2005/0283263 A1 12/2005 Eaton et al.
2006/0210104 A1 9/2006 Shennib et al.
2006/0291683 A1 12/2006 Urso et al.
2007/0019834 A1 1/2007 Nielson
2007/0076909 A1 4/2007 Roeck et al.
2007/0127757 A2 6/2007 Darbut et al.
2007/0195966 A1 8/2007 Fink et al.
2007/0255435 A1 11/2007 Cohen et al.
2007/0274553 A1 11/2007 Rass et al.
2008/0095387 A1 4/2008 Niederdrank et al.
2008/0240452 A1 10/2008 Burrows et al.
2008/0273726 A1 11/2008 Yoo et al.
2009/0052706 A1 2/2009 Gottschalk et al.
2009/0169039 A1 7/2009 Rasmussen et al.
2009/0196444 A1 8/2009 Solum et al.
2010/0027824 A1 2/2010 Atamaniuk et al.
2010/0040250 A1 2/2010 Gerbert
2010/0086157 A1 4/2010 Feeley et al.
2010/0119094 A1 5/2010 Sjursen et al.
2010/0145411 A1 6/2010 Spitzer
2010/0179444 A1 7/2010 Obrien et al.
2010/0201513 A1 8/2010 Vorenkamp et al.
2010/0232612 A1 9/2010 Basseas et al.
2010/0239112 A1 9/2010 Howard et al.
2010/0254553 A1 10/2010 Nikles et al.
2010/0254554 A1 10/2010 Fusakawa et al.
2010/0272299 A1 10/2010 Van Schuylenbergh et al.
2010/0284556 A1 11/2010 Young
2011/0019847 A1 1/2011 Klemenz et al.
2011/0040829 A1 2/2011 Lee et al.

(56) References Cited

U.S. PATENT DOCUMENTS

| | | | |
|---|---|---|---|
| 2011/0058697 | A1 | 3/2011 | Shennib et al. |
| 2011/0091060 | A1 | 4/2011 | von Dombrowski et al. |
| 2011/0182453 | A1 | 7/2011 | Van Hal et al. |
| 2011/0188689 | A1 | 8/2011 | Beck et al. |
| 2011/0200216 | A1 | 8/2011 | Lee et al. |
| 2011/0206225 | A1 | 8/2011 | Møller et al. |
| 2011/0221391 | A1 | 9/2011 | Won et al. |
| 2011/0243357 | A1 | 10/2011 | Probst et al. |
| 2011/0286616 | A1 | 11/2011 | Beck et al. |
| 2011/0293123 | A1 | 12/2011 | Neumeyer et al. |
| 2012/0051569 | A1 | 3/2012 | Blamey et al. |
| 2012/0130271 | A1 | 5/2012 | Margolis et al. |
| 2012/0183164 | A1 | 7/2012 | Foo et al. |
| 2012/0183165 | A1 | 7/2012 | Foo et al. |
| 2012/0189140 | A1 | 7/2012 | Hughes |
| 2012/0189146 | A1 | 7/2012 | Wuidart |
| 2012/0213393 | A1 | 8/2012 | Foo et al. |
| 2012/0215532 | A1 | 8/2012 | Foo et al. |
| 2012/0302859 | A1 | 11/2012 | Keefe |
| 2013/0010406 | A1 | 1/2013 | Stanley |
| 2013/0142367 | A1 | 6/2013 | Berry et al. |
| 2013/0243209 | A1 | 9/2013 | Zurbruegg et al. |
| 2013/0243229 | A1 | 9/2013 | Shennib et al. |
| 2013/0294631 | A1 | 11/2013 | Shennib et al. |
| 2013/0343584 | A1 | 12/2013 | Bennett et al. |
| 2013/0343585 | A1* | 12/2013 | Bennett ..... H04R 25/554 381/315 |
| 2014/0003639 | A1 | 1/2014 | Shennib et al. |
| 2014/0029777 | A1 | 1/2014 | Jang |
| 2014/0150234 | A1 | 6/2014 | Shennib et al. |
| 2014/0153761 | A1 | 6/2014 | Shennib et al. |
| 2014/0153762 | A1 | 6/2014 | Shennib et al. |
| 2014/0247109 | A1 | 9/2014 | Curry |
| 2014/0254843 | A1 | 9/2014 | Shennib |
| 2014/0254844 | A1 | 9/2014 | Shennib |
| 2015/0003651 | A1 | 1/2015 | Han et al. |
| 2015/0023512 | A1 | 1/2015 | Shennib |
| 2015/0023534 | A1 | 1/2015 | Shennib |
| 2015/0139474 | A1 | 5/2015 | Henry et al. |
| 2015/0382198 | A1 | 12/2015 | Kashef et al. |
| 2016/0049074 | A1 | 2/2016 | Shennib |
| 2016/0057550 | A1 | 2/2016 | Shennib |
| 2016/0100261 | A1 | 4/2016 | Shennib |
| 2016/0134742 | A1 | 5/2016 | Shennib |
| 2017/0063434 | A1 | 3/2017 | Hviid et al. |
| 2017/0112671 | A1 | 4/2017 | Goldstein |
| 2017/0180883 | A1 | 6/2017 | Sommer et al. |
| 2017/0332183 | A1 | 11/2017 | Shennib |
| 2018/0025627 | A1 | 1/2018 | Shennib |
| 2020/0213782 | A1 | 7/2020 | Shennib |
| 2020/0213784 | A1 | 7/2020 | Shennib |
| 2020/0304624 | A1 | 9/2020 | Shennib |

FOREIGN PATENT DOCUMENTS

| | | |
|---|---|---|
| WO | 99/07182 | 2/1999 |
| WO | 2010/091480 | 8/2010 |
| WO | 2011128462 | 10/2011 |
| WO | 2011159349 | 12/2011 |
| WO | 2015009564 | 1/2015 |
| WO | 2015009569 | 1/2015 |
| WO | 2016025826 | 2/2016 |

OTHER PUBLICATIONS

"Methods for Calculation of the Speech Intelligibility Index", American National Standards Institute, Jun. 6, 1997.

"Specification for Audiometers", American National Standards Institute, Nov. 2, 2010.

"User Manual—2011", AMP Personal Audio Amplifiers.

Abrams, , "A Patient-adjusted Fine-tuning Approach for Optimizing the Hearing Aid Response", The Hearing Review, Mar. 24, 2011, 1-8.

Asha, "Type, Degree, and Configuration of Hearing Loss", American Speech-Language-Hearing Association; Audiology Information Series, May 2011, 1-2.

Convery, et al., "A Self-Fitting Hearing Aid: Need and Concept", http://tia.sagepubl.com, Dec. 4, 2011, 1-10.

Franks, "Hearing Measurements", National Institute for Occupational Safety and Health, Jun. 2006, 183-232.

Kiessling, "Hearing aid fitting procedures—state-of-the-art and current issues", Scandinavian Audiology vol. 30, Suppl 52, 2001, 57-59.

Nhanes, "Audiometry Procedures Manual", National Health and Nutrition Examination Survey, Jan. 2003, 1-105.

Traynor, "Prescriptive Procedures", www.rehab.research.va.gov/mono/ear/traynor.htm, Jan. 1999, 1-16.

World Health Organization, "Deafness and Hearing Loss", www.who.int/mediacentre/factsheets/fs300/en/index.html, Feb. 2013, 1-5.

Wu, et al., "Selective Signal Transmission to Inlaid Microcoils by Inductive Coupling", IEEE Transducers 2003, 12th International Conference of Solid State Sensors Transducers, Boston 2003.

* cited by examiner

WIRELESS HEARING DEVICE FOR TRACKING ACTIVITY AND EMERGENCY EVENTS

CROSS-REFERENCE TO RELATED APPLICATIONS

This application is a continuation of U.S. application Ser. No. 15/669,747, filed Aug. 4, 2017, issued as U.S. Pat. No. 10,587,964 on Mar. 10, 2020, which is a continuation of U.S. application Ser. No. 14/832,751 filed Aug. 21, 2015, issued as U.S. Pat. No. 9,769,577 on Sep. 19, 2017, which claims the benefit under 35 U.S.C. 119 of the earlier filing date of U.S. Provisional Application No. 62/041,001 entitled "TRAGUS ACTIVATED CANAL HEARING DEVICE AND METHODS FOR WIRELESS REMOTE CONTROL OF AN APPLIANCE," filed Aug. 22, 2014. The aforementioned applications and patents are hereby incorporated by reference in their entirety, for any purpose.

TECHNICAL FIELD

Examples described herein relate to hearing devices, and include particularly canal hearing devices including wireless capabilities for actuation, control, or communications with an external appliance, including a medical device.

BACKGROUND

The ear canal 10, as illustrated in FIGS. 1, 6 and 8, is generally narrow and tortuous, and is approximately 26 millimeters (mm) long from the canal aperture 11 to the tympanic membrane 15 (eardrum). The lateral part of the ear canal 10 is referred to as the cartilaginous region 12 due to the underlying cartilaginous tissue 16 beneath the skin. The medial part, proximal to the tympanic membrane 15, is relatively rigid and referred to as the bony region 13 due to the underlying bone tissue 17. A characteristic first bend occurs roughly at the aperture 11 (FIG. 1) of the ear canal 10. The concha cavity 5 is just outside the ear canal 10 behind a tragus 3 of the ear. A second characteristic bend occurs roughly at the bony-cartilaginous junction 8 and separates the cartilaginous region 12 and the bony region 13. The two bends inside the ear canal 10 define a characteristic "S" shape. Just outside the ear canal 10 is the concha cavity 5, which is hidden behind the tragus 3. The ear canal 10 and concha cavity 5 are generally hidden from view from the front and side by the presence of the tragus 3, and also hidden from the back by the presence of the pinna (also referred to as auricle). Therefore, placement of a hearing device inside the concha cavity 5 and into the ear canal 10 is highly advantageous for highly inconspicuous wear. The dimensions and contours of the ear canal 10 vary significantly among individuals.

Placement of a canal hearing device inside the ear can be challenging due to difficulty in access and manipulation of a miniature canal device, particularly when intended for placement inside the ear canal 10 for achieving various advantages including reduction of the acoustic occlusion effect, improved energy efficiency, reduced distortion, reduced receiver (speaker) vibrations, and improved high frequency response. A well-known advantage of ear canal 10 placement is also aesthetics as many hearing-impaired individuals refuse to wear visible hearing devices such as in-the-ear (ITE) or behind-the-ear (BTE) types.

A canal hearing device can be inserted entirely or partially inside the ear canal. In the context of this application, any hearing device inserted inside the ear canal, whether partially or completely, may be referred to as a canal hearing device. This includes what is known in the hearing aid industry as Completely-In-The-Canal (CIC) and In-The-Canal (ITC) types.

Switches placed on canal hearing devices are generally difficult to reach or activate. These switches may be cumbersome if not impossible for those with dexterity limitations. Switches for hearing devices are generally implemented for larger hearing devices such as BTEs and ITEs for access and manual manipulation to deal with dexterity limitations.

Current hearing devices include wireless capabilities to receive transmit a variety of signals. The signals may include telephony audio, consumer electronics audio, and/or programming signals. In some examples, hearing devices connect to a computing device such as a mobile device or a personal computer to receive the wireless signals. In some examples, wireless hearing devices connect with an intermediary device that receives wireless signals from a source device external to the hearing device and re-trans s or relays the signal to the hearing device in proximity to the intermediary device.

SUMMARY

A canal hearing device may include a medial portion, a lateral portion, and wireless electronics. The medial portion may include a speaker. The medial portion may be configured for placement in an ear canal of an ear. The lateral portion may include a wireless antenna and one or more switches. At least one of the switches may be arranged on the lateral portion such that the switch is located in a concha cavity of the ear when the medial portion is placed inside the ear canal. At least one of the switches may be provided behind a tragus of the ear for manual activation by the tragus.

The canal hearing device may include wireless electronics communicatively coupled to the wireless antenna. The wireless electronics may be configured to transmit a wireless signal to an external appliance in proximity to the canal hearing device and/or a remote medical alert service. The wireless signal may be transmitted responsive to manual activation of the switch. In some examples, the external appliance may be a medical device. The canal hearing device may wirelessly control one or more functions of the external appliance in response to activation of at least one of the switches. The canal hearing device may produce an audio signal from the speaker when the canal hearing device is in proximity to the external appliance.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Certain details are set forth below to provide a sufficient understanding of embodiments of the invention. However, it will be appreciated by one skilled in the art that some embodiments may not include all details described. In some instances, well-known structures, hearing aid components, circuits, and controls have not been shown in order to avoid unnecessarily obscuring the described embodiments of the invention.

The present disclosure describes examples of systems and methods of wireless remote control of appliances external to the ear using a canal hearing device. One embodiment of the present disclosure involves a canal hearing devices including a switch for manual activation. In some examples, the canal hearing device may control an appliance external to the ear upon manual activation of the switch.

Figure 1:
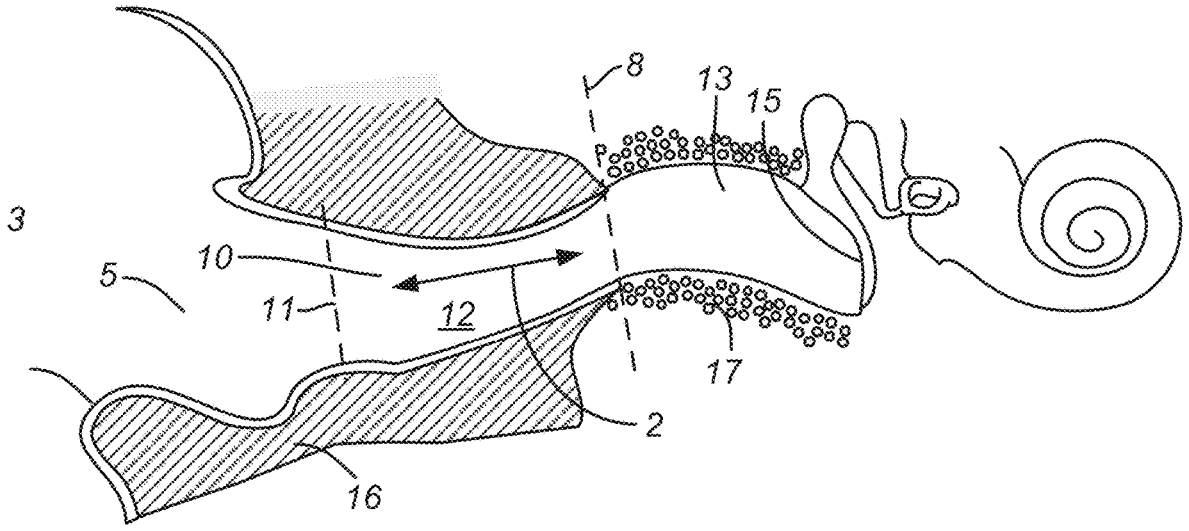
FIG. 1 is a view of the ear canal showing the bony and cartilaginous regions, and the concha cavity.
Figure 2:
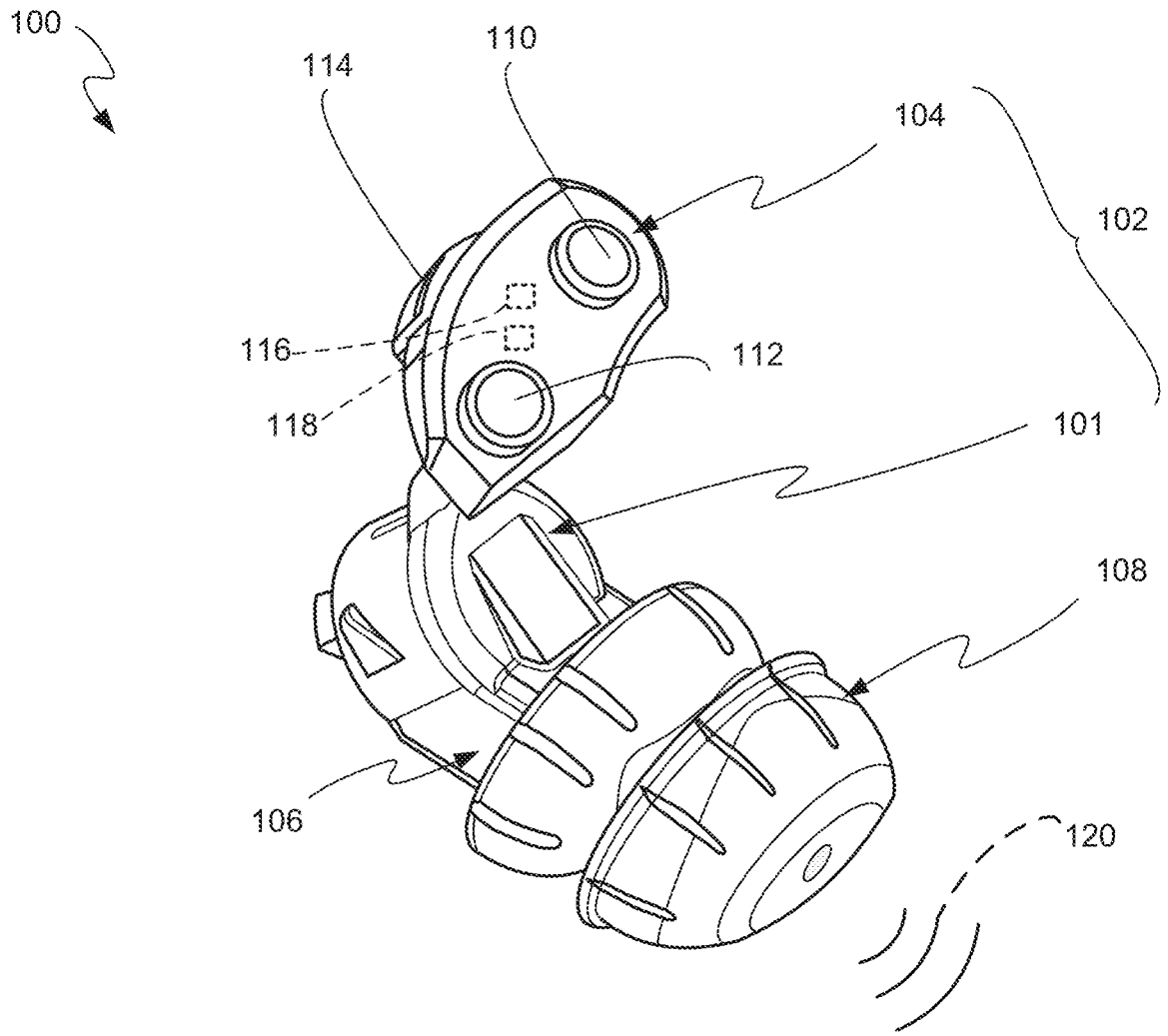
FIG. 2 is a view of a canal hearing device including button switches for wireless remote control of an appliance, according to some examples.
Figure 3:
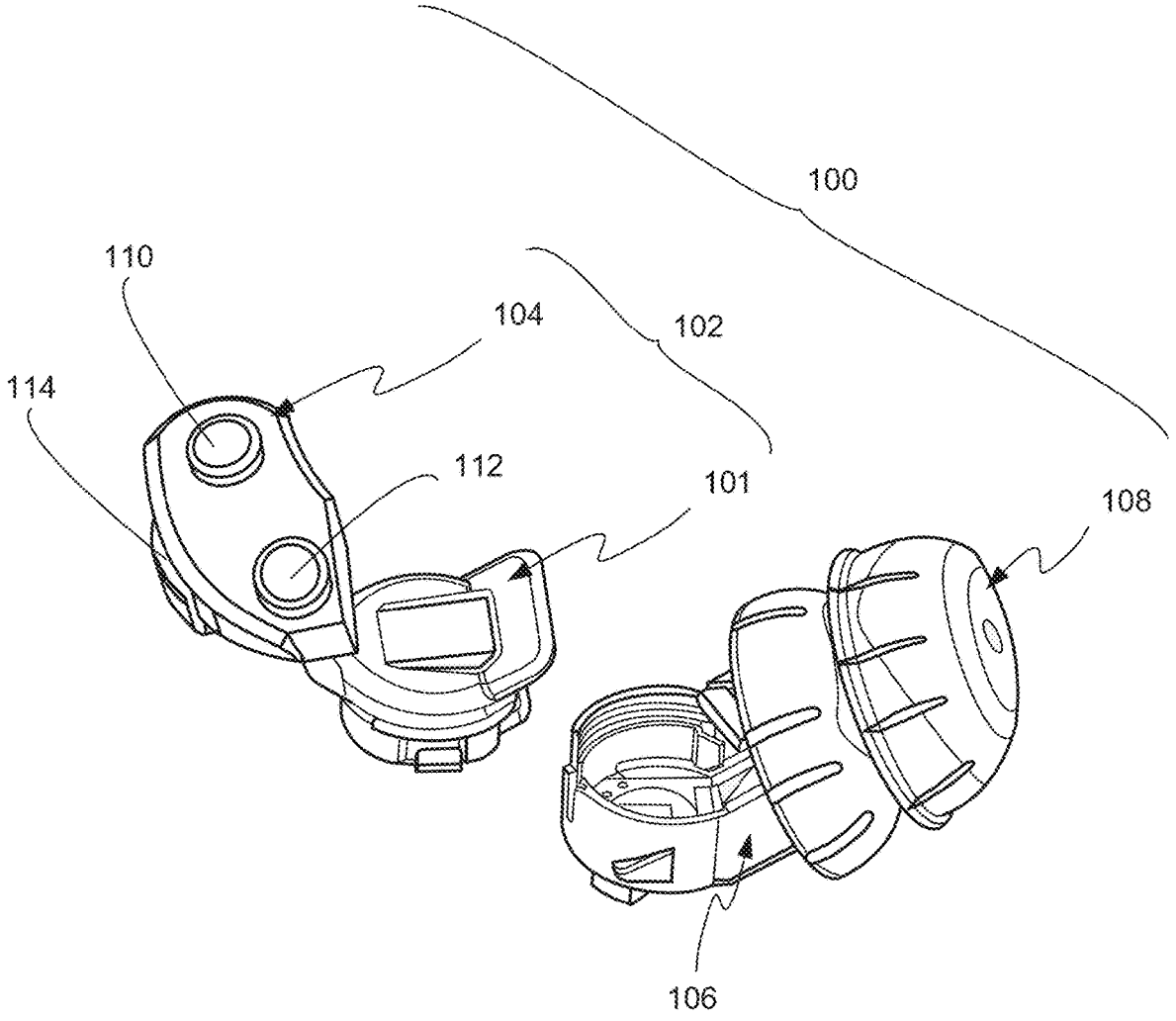
FIG. 3 is a view of a canal hearing device according to some examples herein, with the lateral end of the canal hearing device detached from the medial end of the canal hearing device.
Figure 12:
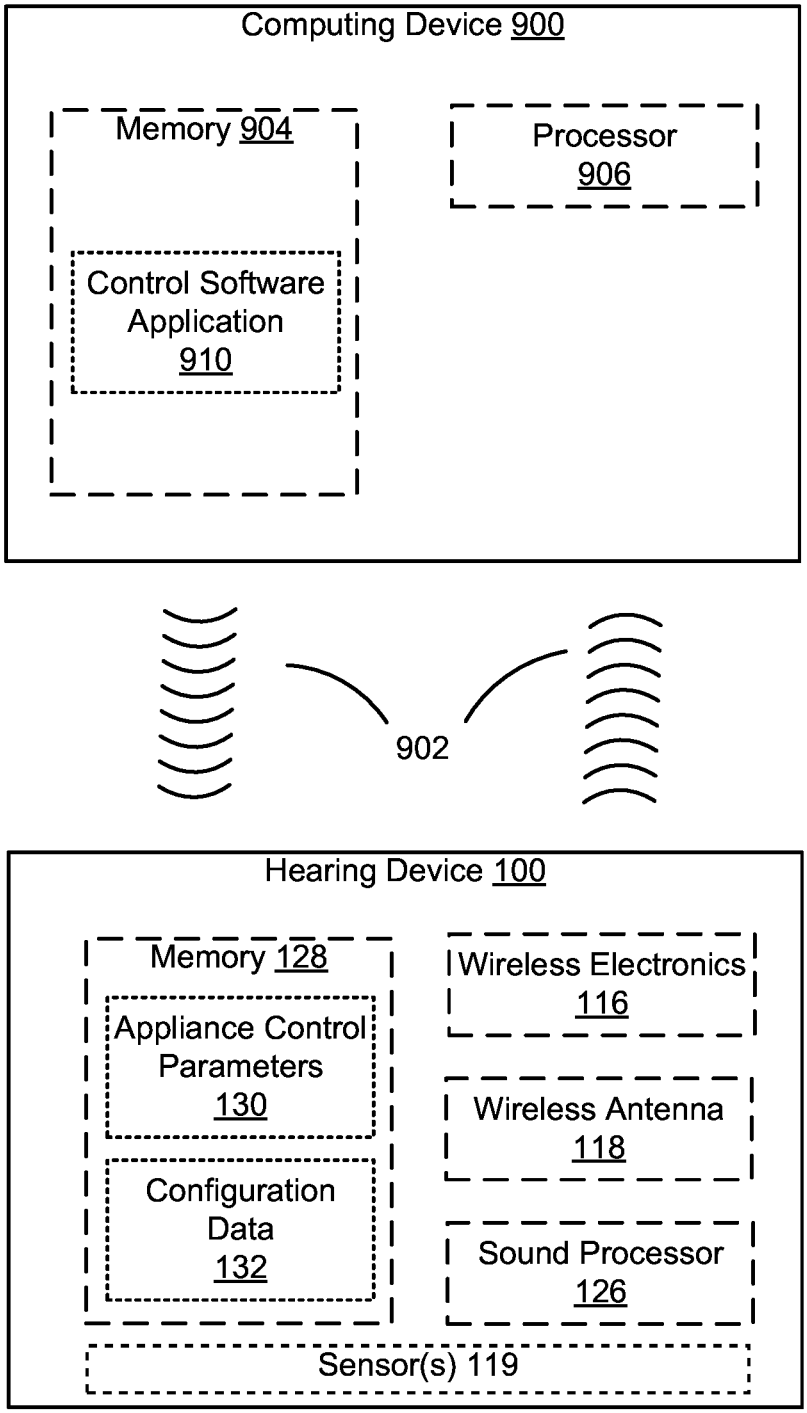
FIG. 12 is a block diagram of an operational environment including a canal hearing device communicatively coupled to a computing device for configuring appliance control parameters, according to some examples.
Figure 13:
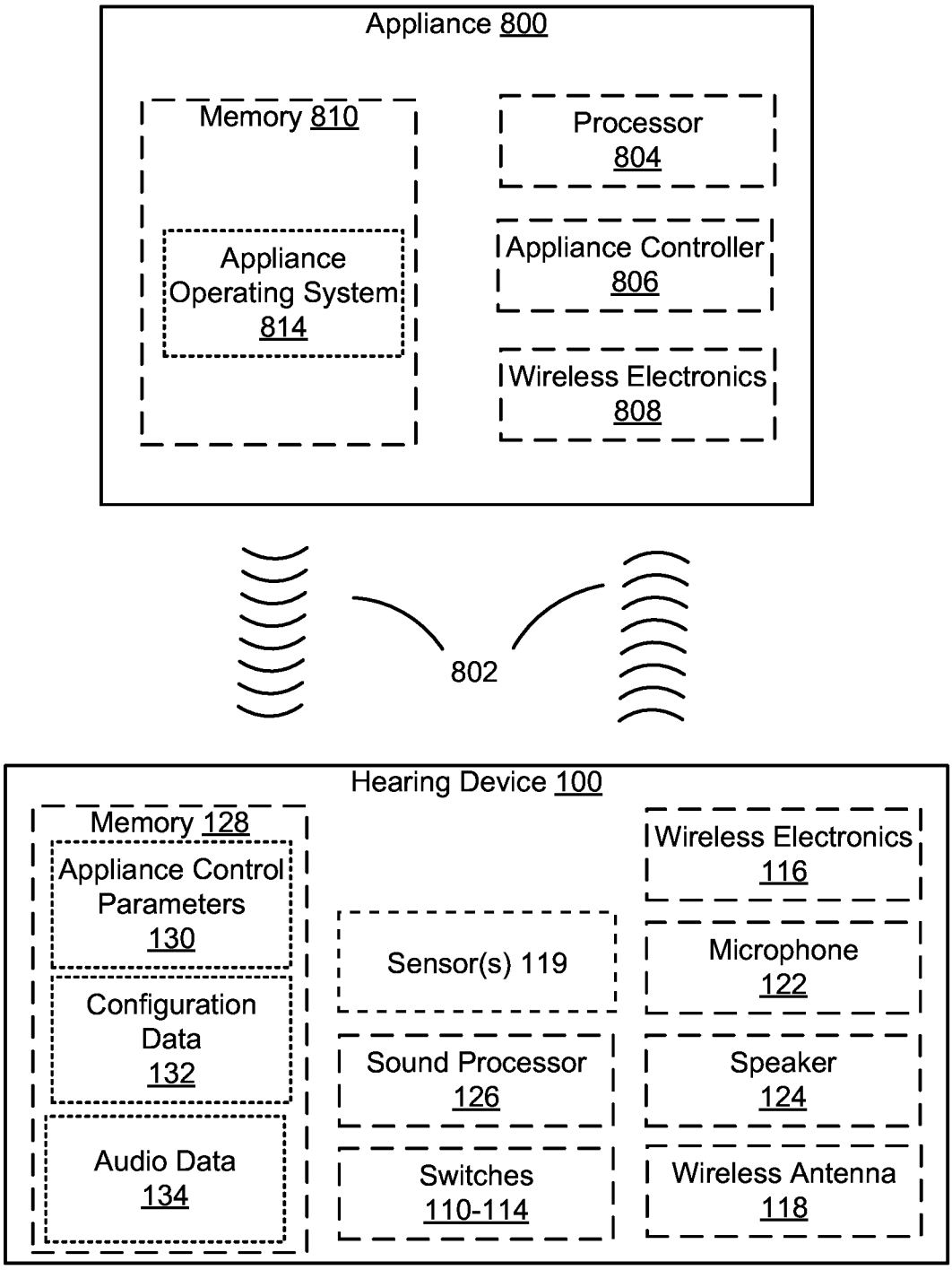
FIG. 13 is a block diagram of an operational environment including a canal hearing device communicatively coupled to an appliance for wireless remote control of the appliance, according to some examples.

FIGS. 2 and 3 show examples of a canal hearing device 100, according to the present disclosure. The canal hearing device 100 may include a medial portion 106, a lateral portion 102, and a compliant canal retainer 108. The canal hearing device 100 may include wireless electronics 116 (e.g., as illustrated in FIG. 12). The lateral portion 102 may be coupled electrically and mechanically to the medial portion 106 for operation of the canal hearing device 100 in the ear. In some examples, the medial portion 106 may be integrated with the lateral portion 102. In some examples, the canal hearing device 100 may be a modular canal hearing device which includes a medial portion 106 (also referred to herein as "main module") and a lateral portion 102 (also referred to herein as "lateral module") removably coupled to the medial portion 106. The lateral portion 102 may be at least partially disengageable from the medial portion 106, as illustrated in FIG. 3. Partial disengagement may provide the canal hearing device 100 in an OFF condition. Engagement between the medial portion 106 and lateral portion 102 may provide the canal hearing device 100 in an ON condition. The canal hearing device 100 may be sized and shaped for placement inside the ear canal 10 and extending to the concha cavity 5 behind the tragus 3. The medial portion 106 may be placed inside an ear canal 10. The canal hearing device 100 (FIG. 13) may include any of a speaker 124, a microphone 122, a sound processor 126, memory 128 and circuitry.

The lateral portion 102 may be positioned lateral to (away from the eardrum 15) and may include a battery portion 101 and a handle portion 104 (also referred to herein as "handle") for placement in the concha cavity 5 behind the tragus 3. The lateral portion 102 may include one or more switches, a wireless antenna, and a battery cell. In some examples, the battery cell may be rechargeable. The lateral portion 102 may be removable, partially disengageable, or integral with the medial portion 106. The lateral portion 102 may further include a sound port and sound channel for receiving incoming sound, for example as described in U.S. Pat. No. 8,467,556, titled CANAL HEARING DEVICE WITH DISPOSABLE BATTERY MODULE ("'556 patent"), and U.S. Pat. No. 8,855,345, titled BATTERY MODULE FOR PERPENDICULAR DOCKING INTO A CANAL HEARING DEVICE ("'345 patent"), which are both incorporated herein by reference in their entirety for any purpose. In some examples, the compliant canal retainer 108 may be removably coupled to the medial end 106 and configured to retain the canal hearing device 100 in the ear. In some examples, the compliant canal retainer 108 may be removable and provided in an assortment of sizes to fit in a variety of ear canal shapes and sizes. In some examples, the compliant canal retainer 108 is disposable.

Figure 6:
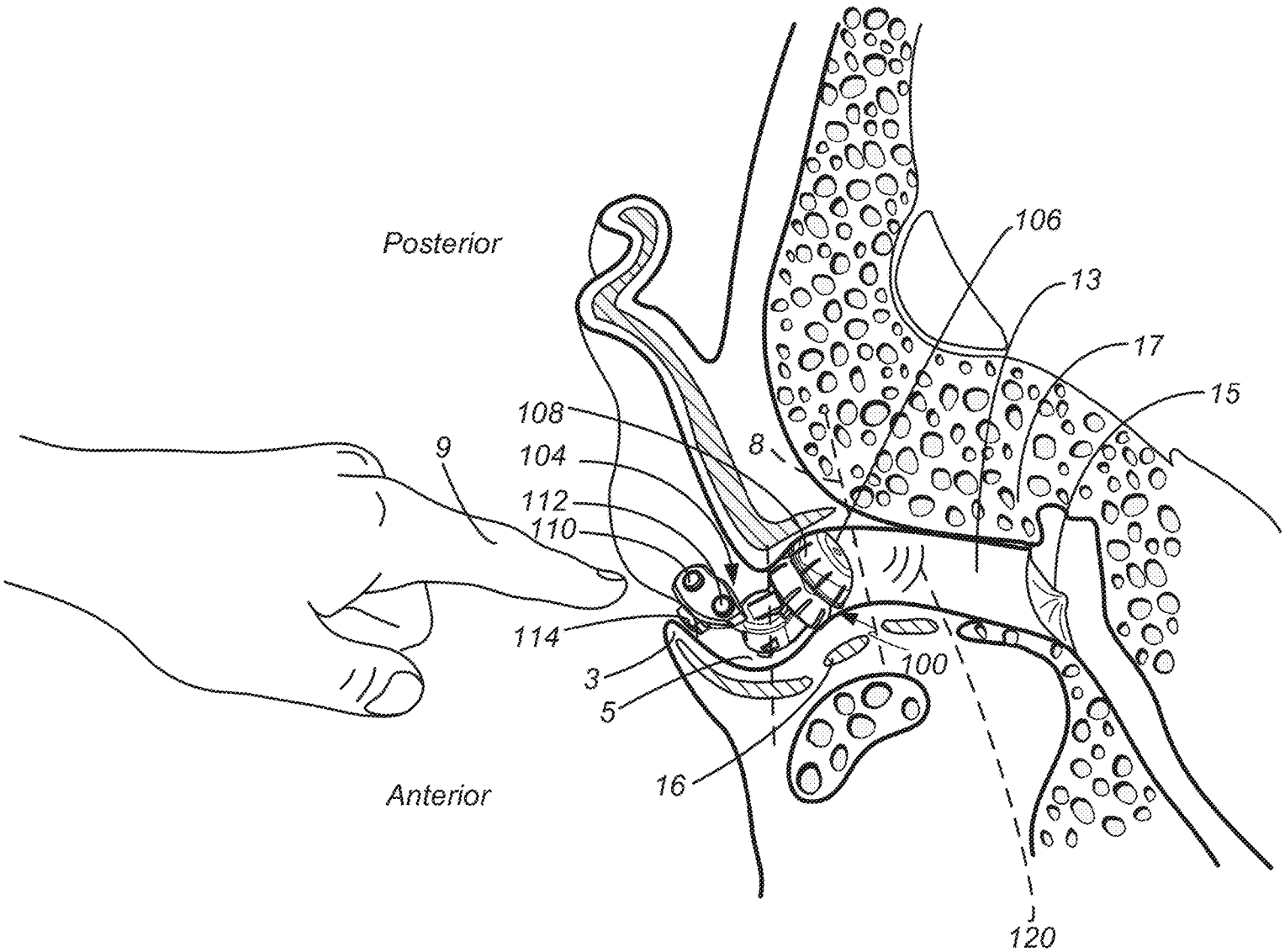
FIG. 6 is a transverse view of the ear canal showing a canal hearing device with multiple switches provided on a handle positioned generally behind the tragus when viewed from the front or side, according to some examples.
Figure 7:
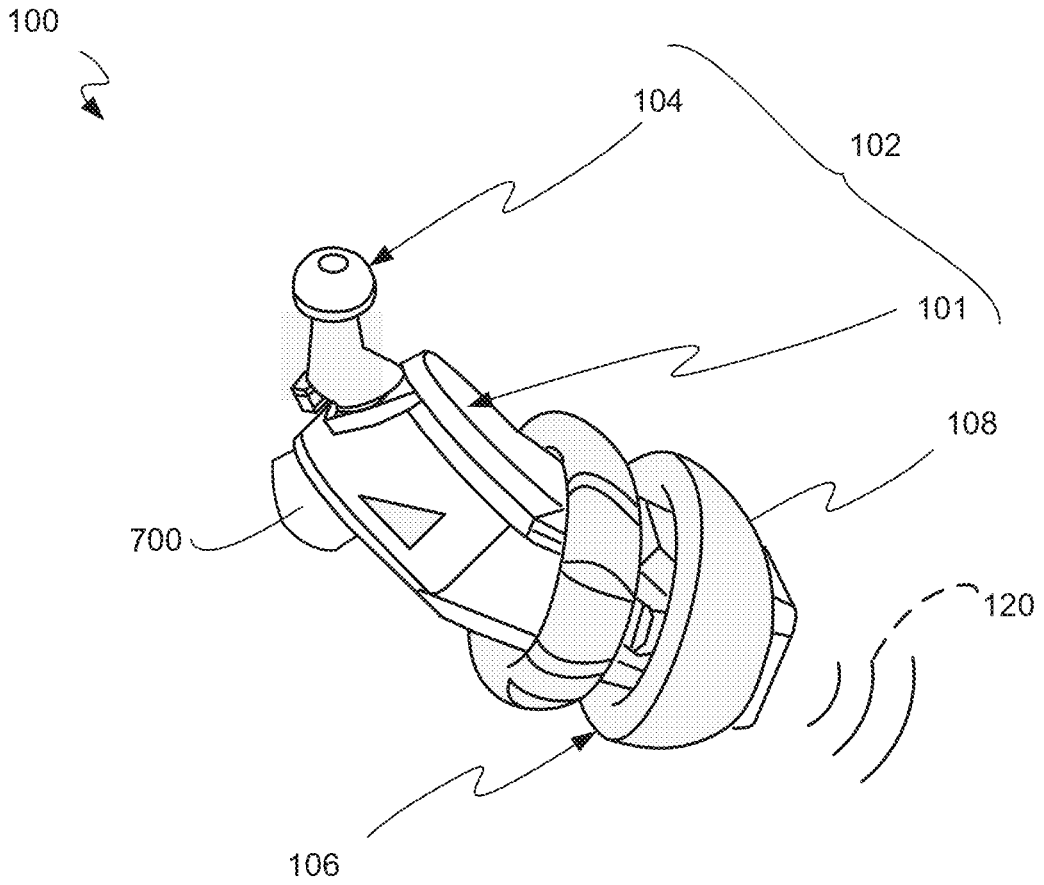
FIG. 7 is view of a canal hearing device including a button switch on a side of a lateral end for activation by a manual force applied to a tragus to wirelessly control an appliance, according to some examples.
Figure 9:
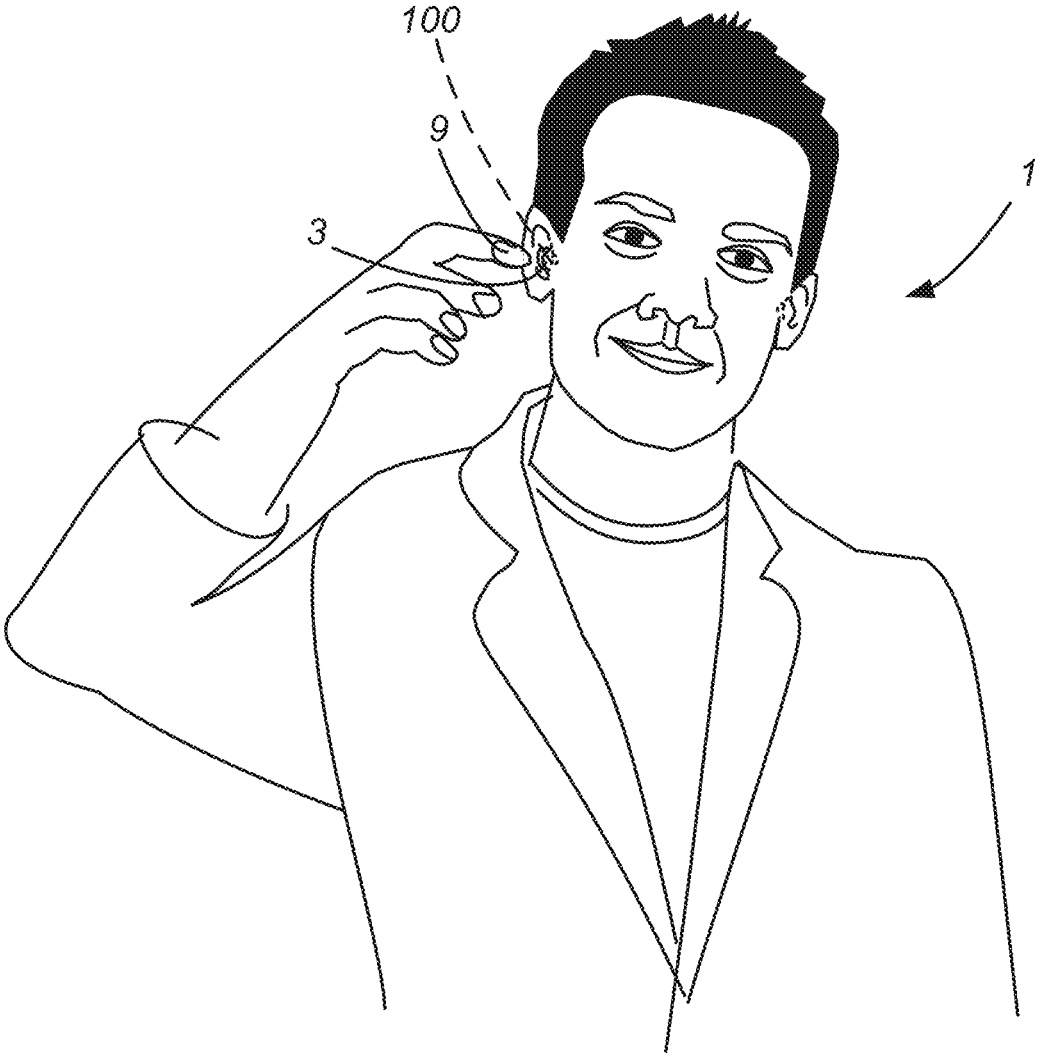
FIG. 9 is an illustration of a canal hearing device such that switches of the canal hearing device are positioned behind a tragus for manual activation by an application of manual force (e.g., by a finger of the user), according to some examples.

The lateral portion 102 may include one or more switches that may be activated in response to a manual force. In some examples, the one or more switches may be provided on the handle 104 of the canal hearing device 100. In some examples, the one or more switches may be provided on a housing of the lateral portion 102, such as on the side of the housing (FIG. 7). In some examples, a first switch 114 may be activated indirectly by a manual force applied to a tragus 3. In some examples, the first switch 114 may be arranged on the lateral portion 102 such that the first switch 114 is oriented towards the tragus 3 when the medial portion 106 is placed inside the ear canal. In this manner, the application of manual force to the tragus 3 may cause the tragus 3 to contact the first switch 114 thereby activating the first switch 114. In some examples, a second switch 110 may be activated by a manual force directly applied to a first area of the handle 104. In some examples, a third switch 112 may be activated by a manual force directly applied to a second area of the handle 104. Any of the one or more switches may be arranged on the lateral portion 102 of the canal hearing device 100 such that one or more of the switches are located in the concha cavity 5. In this manner, one or more of the switches may be provided generally hidden behind the tragus 3 (FIGS. 6 and 9) for inconspicuous wear of the canal hearing device in the ear. The one or more switches may include a button switch (FIGS. 2-3, 7 and 9), a rocker switch 502 (FIG. 4), a proximity sensor switch (not shown), a capacitive switch (not shown), and/or other known switches suitable for manual activation.

Figure 4:
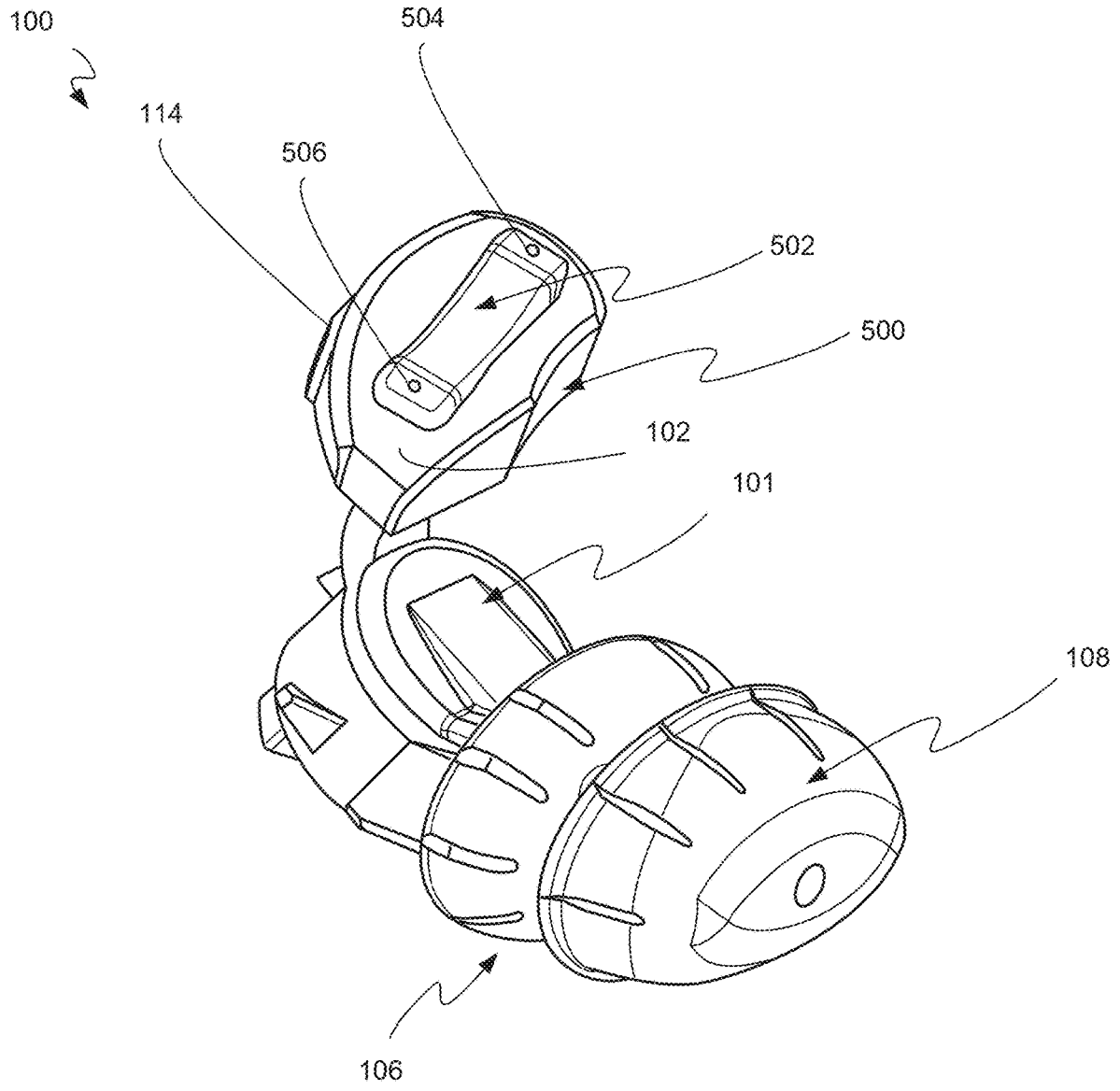
FIG. 4 is a view of a canal hearing device including a rocker switch for wireless remote control of an appliance, according to some examples.
Figure 8:
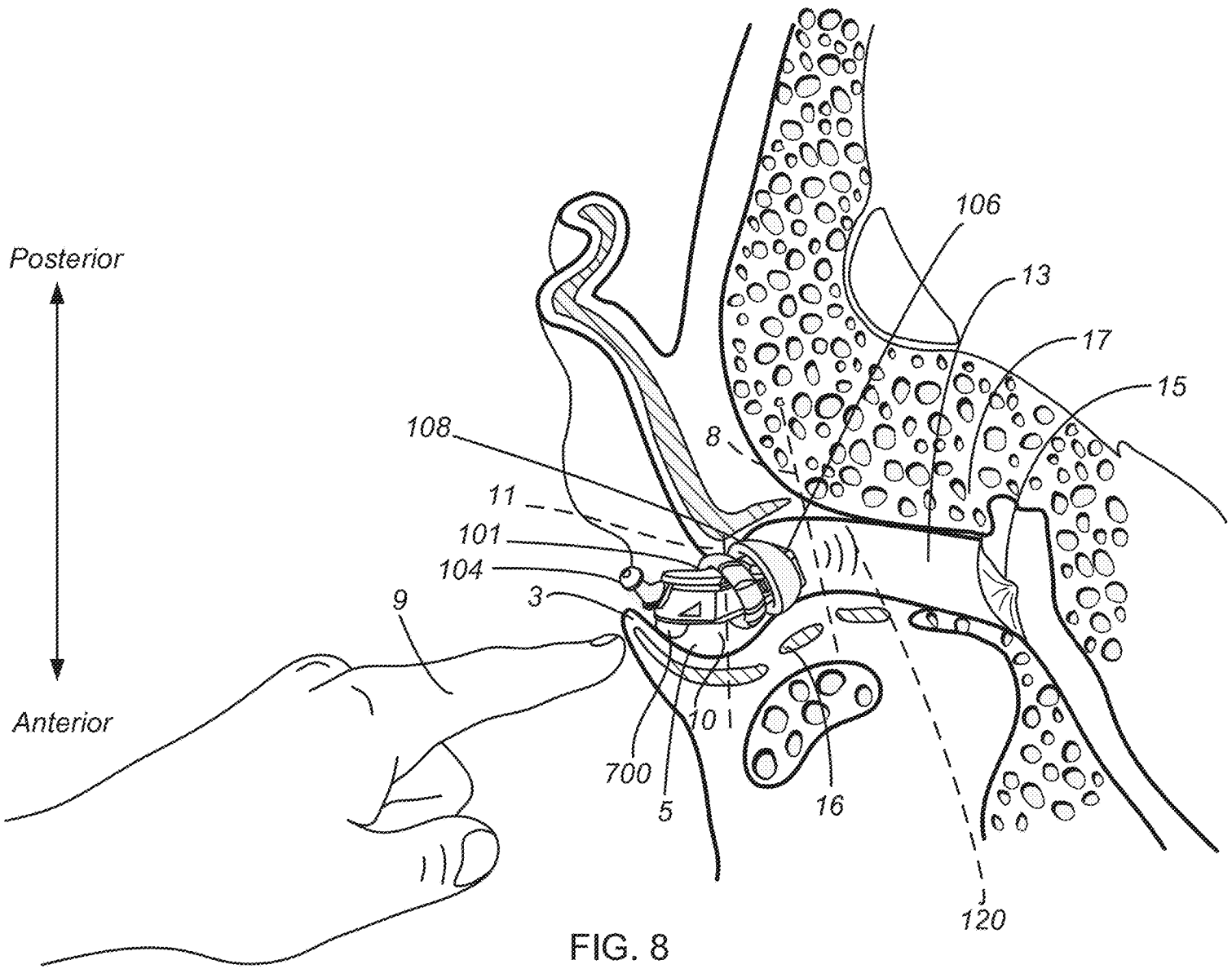
FIG. 8 is a view of the canal hearing device of FIG. 7 showing the activation of the switch by a manual force applied to a tragus, according to some examples.
Figure 11:
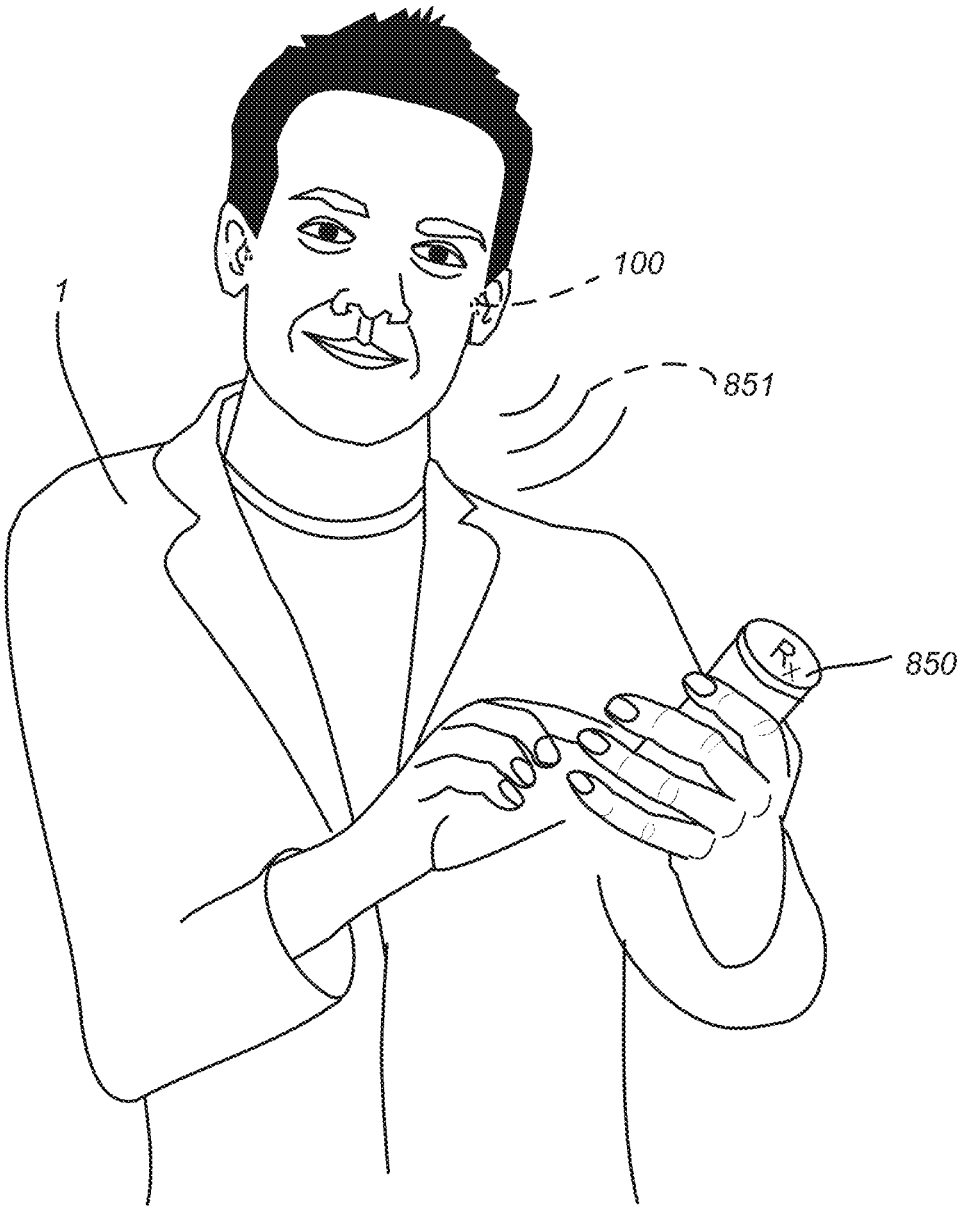
FIG. 11 is an illustration of a canal hearing device inserted in an ear canal of a user and in communication with a medical device, according to some examples.

In some examples, the one or more switches may be implemented as a rocker switch 502 on a handle 500 of the canal hearing device 100, as shown in FIG. 4. The rocker switch 502 may include two switches each configured to be manually activated. The two switches may include a first switch 504 located at a first end of the rocker switch 502 and a second switch 506 located at a second end of the rocker switch 502. Manual manipulation of either of the first or second end of the rocker switch (e.g., a pressure applied to the first end or the second end) may cause activation of the respective switch located at that end. In some examples, any of the switches may be positioned such that they may be reached by a finger 9 of a user 1, as shown in FIGS. 6 and 11. Alternatively, a switch 700 may be provided on a side of the lateral portion 102 such that the switch 700 is behind the tragus 3 when the medial portion 106 of the canal hearing device 100 is positioned in the ear canal 10, as shown in FIG. 8. In some examples, the user 1 may apply a manual force to the tragus 3 using a finger 9 to activate the switch. In some examples, the user 1 may apply a manual force to the tragus 3 using a tool to activate the switch.

The lateral portion 102 may include a wireless antenna 118. In some examples, the wireless antenna 118 may be a chip antenna, for example a ceramic chip antenna. The wireless antenna 118 may be communicatively coupled to wireless electronics 116 of the canal hearing device 100. The wireless electronics 116 may be provided in any of the medial portion 106 or the lateral portion 102. The wireless electronics 116 may include functionality to transmit and receive wireless signals. The wireless electronics 116 may utilize standardized protocols, such as Bluetooth, near-field magnetic induction, Wi-Fi, Zigbee or any other known wireless protocol. In some examples, the wireless electronics 116 include low power and low energy functionalities compatible with miniature button cell or coin cell batteries commonly used for hearing aids and miniature electronic devices. Bluetooth, including Low Energy (LE) versions, is particularly suited.

Figure 5:
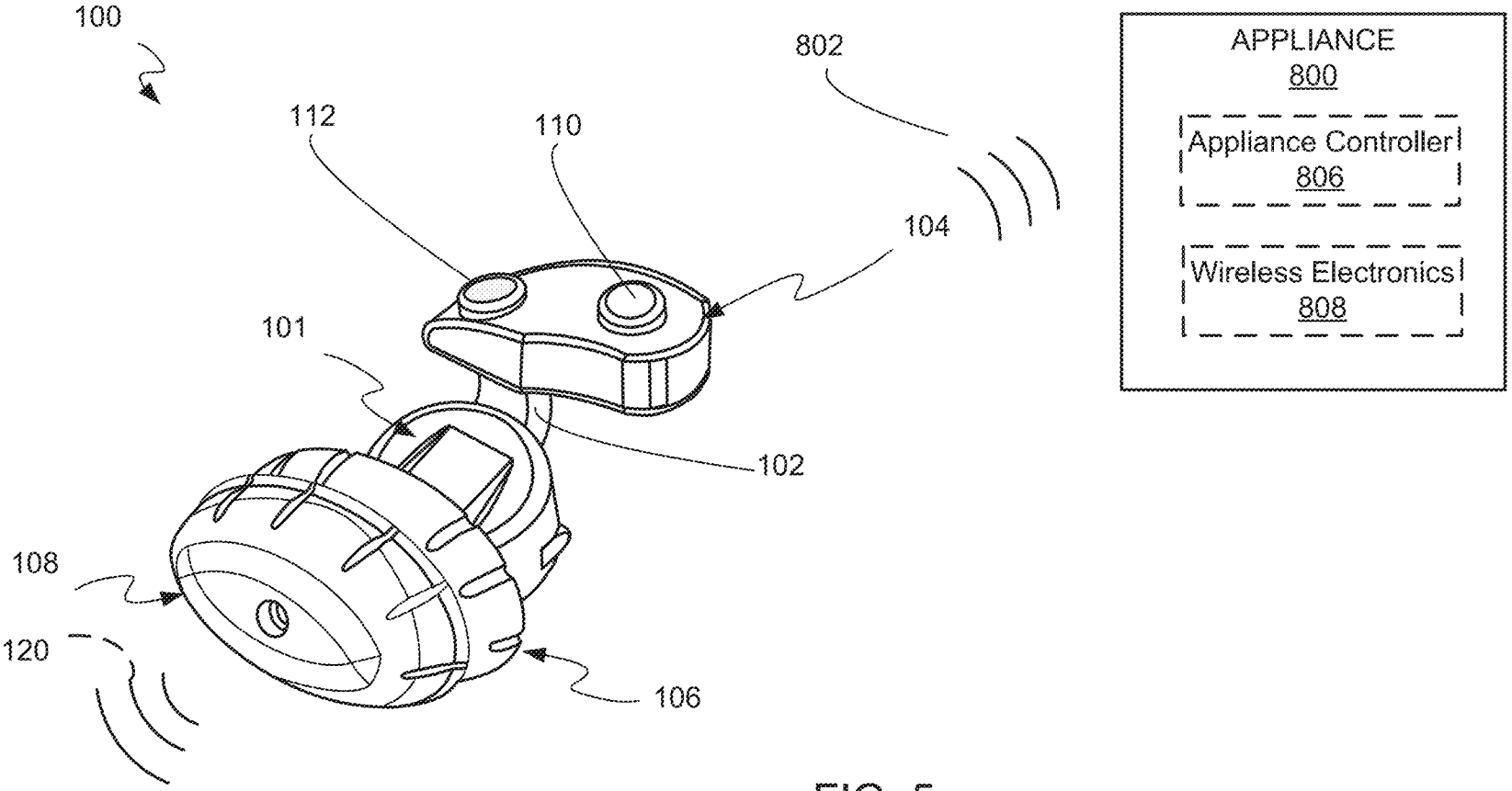
FIG. 5 is a view of a canal hearing device including a handle and switches provided on the handle for wireless control of an appliance, according to some examples.

The wireless electronics 116 may communicate wirelessly with an appliance 800 (FIG. 5) external to the ear. The appliance 800 external to the ear may interchangeably be referred to herein as external appliance 800. The appliance 800 may be any device with wireless capability, for example an electronic lock (e.g., electronic door lock), a thermostat, electronic lighting (e.g., electronic room lighting), a telephone, a kitchen appliance, a medical alert system, a television, a medical device including an electronic medicine dispensing bottle, or a smart glass (also referred to herein as "electronic glass"). The appliance 800 may include wireless electronics 808 for communicatively coupling with the canal hearing device 100 and receiving control signals therefrom. An appliance controller 806 of the appliance 800 may provide configuration or control parameters such as ON/OFF, Open/Close, Up/Down (e.g., volume), and Increase/Decrease (e.g., temperature). Typically, these control parameters are controlled by switches on the appliance 800 itself, or by an external remote control. More recently, appliance operating systems 814 may include functionality for wireless control by a Smartphone and a control software application 910 (FIG. 12). In some examples, the switches of the canal hearing device 100 may include an electromechanical type, a capacitive touch type, or optical sensor. A smartphone may be used to control the appliance 800. Examples disclosed herein may mitigate the need to rely on inaccessible devices and methods for the remote control of an appliance 800 by using the canal hearing device 100 to control the appliance 800 (e.g., to operate controls of the appliance and/or activate the appliance 800).

The wireless electronics 116 of the canal hearing device 100 may communicatively couple with wireless electronics 808 of the appliance 800 to transmit and receive wireless signals 802. The wireless signals 802 may include commands, audio, and/or any other type of data. In some examples, the wireless electronics 116 of the canal hearing device 100 may transmit a wireless signal 802 in response to the manual activation of any of the one or more switches of the canal hearing device 100. The wireless signal 802 may include a signal configured to control the appliance 800. The wireless signal 802 may be received by the appliance 800, and a processor 804 of the appliance 800 may be in communication with the appliance controller 806 and an appliance operating system 814 to control the appliance 800. The appliance 800 may include memory 810 for storing appliance configuration data and the appliance operating system 814. The appliance configuration data may include control parameters for control and/or actuation of the appliance 800 in response to receiving the wireless signal 802. Thus, the user 1 may apply a manual force to the tragus 3 and/or directly to any of the switches 110-114 of the canal hearing device 100 to control the appliance 800. The actuation and/or control of the appliance 800 may include adjustment of the appliance 800 as discussed above, such as manipulating a light or lock. Thus, it may be advantageous to use a canal hearing device 100 as a remote control to mitigate the need for an external remote device such as a remote control or a mobile phone.

In some examples, the canal hearing device 100 may automatically detect the presence of an external appliance 800 in proximity. In other words, the canal hearing device 100 may be configured to automatically detect the external appliance 800 when the external appliance 800 is within a wireless detection range. The appliance 800 may be in sufficient proximity to the canal hearing device 100 such that a wireless signal may be received from and/or transmitted to the canal hearing device 100 from the appliance 800. It will be appreciated that the distance defining proximity depends on the wireless capability of the canal hearing device 100 and the wireless protocol. For example, a proximity range may be 2-10 meters for low energy Bluetooth. In some examples, a proximity range may be extended using a mesh network. In some examples, the wireless electronics 116 may periodically scan for the presence of an appliance 800, or respond to a scan from the appliance 800. In some examples, the wireless electronics 116 may perform a scan in response to a manual activation of a switch 110-114. The canal hearing device 100 may pair to the proximately positioned appliance 800 upon detection of the appliance 800. The canal hearing device 100 may access appliance control parameters 130 associated with the detected appliance 800 and configuration data 132 from memory 128 of the canal hearing device 100. The appliance control parameters 130 determine the control associated with the appliance 800 and/or switch mapping for the appliance 800 (e.g., which switch performs which command). The configuration data 132 may include personal user settings, personal fitting parameters, appliance preferences, etc. For example, the configuration data 132 may include appliance preferences ranking appliances based on usage or user preference, automatic control settings of an appliance 800 (e.g., automatic door unlock), and/or alert settings for an appliance 800.

In some examples, the canal hearing device 100 may be configured to produce an audible signal from the speaker 124 when the canal hearing device 100 is worn in the ear and in proximity to the appliance 800. In some examples, the canal hearing device 100 includes a speaker 124 in the medial portion 106 to transmit audible signals 120 into the ear canal 10. The audible signal 120 may be representative of audio signals streamed from an appliance 800 or internally generated by the canal hearing device 100, for example by playing back an audio segment related to the appliance 800 in proximity. In some examples, audio data 134 associated with the audio segment may be stored in memory 128 of the canal hearing device 100. The audio data 134 stored in memory 128 may be accessed and the audio segment may be played back using the sound processor 126 within the canal hearing device 100 in response to the detection. The audio segment may be played back in response to the activation or control of the appliance 800, which may be caused by activation of a switch of the canal hearing device. The production of the audible signal 120 may be terminated by manually activating a switch of the canal hearing device 100. The terms audio segment and audible segment may be used interchangeably herein.

In some examples, the canal hearing device 100 may automatically detect the presence of the appliance 800. In response to detection of the appliance 800, the canal hearing device 100 may transmit an appropriate audible signal 120 (e.g., an audible segment) to a user 1 wearing the canal hearing device 100. The audible signal 120 may be produced through the speaker 124. The audible signal 120 may alert the user 1 to the presence of the appliance 800 in proximity and allow the user 1 to wirelessly control the appliance 800 detected in proximity by the canal hearing device 100. In some examples, control of the appliance 800 is automatic. Thus, the one or more switches of the canal hearing device 100 may not be required to control the appliance 800. The canal hearing device 100 may detect the presence of an appliance 800 in proximity to the canal hearing device 100 and control the appliance 800 based on appliance control parameters 130 and configuration data 132 (collectively referred to herein as "configuration parameters") stored within memory 128 of the canal hearing device 100. For example, the canal hearing device 100 may detect the presence of a lock and in response to detecting the lock, the canal hearing device 100 may wirelessly transmit a secure open-door command signal to unlock a door for entry. This may be advantageous to provide a hands-free home entry for a user 1 wearing the canal hearing device 100. In other examples, the open-door command is transmitted upon activation of a hearing device switch positioned in the concha cavity 5 behind the tragus 3, according to the examples of the present disclosure.

In some examples, upon detection of the appliance 800 in proximity, the canal hearing device 100 may retrieve appliance status data of the appliance 800, for example whether a door is locked or unlocked, or whether the appliance is on or off. The canal hearing device 100 may transmit a wireless control signal to the appliance based on the appliance status data. For example, the canal hearing device 100 may transmit a wireless control signal to unlock the door only when the appliance status data indicates that the door is locked and will not perform any action if the door is already unlocked. In some examples, the canal hearing device 100 may detect whether the appliance 100 is getting closer or further away when in proximity range, for example when the user 1 is approaching a door or moving away from the door, and send a wireless control signal accordingly. For example, the canal hearing device 100 may unlock a door when the user 1 is approaching and lock a door when the user 1 is moving away.

Figure 10:
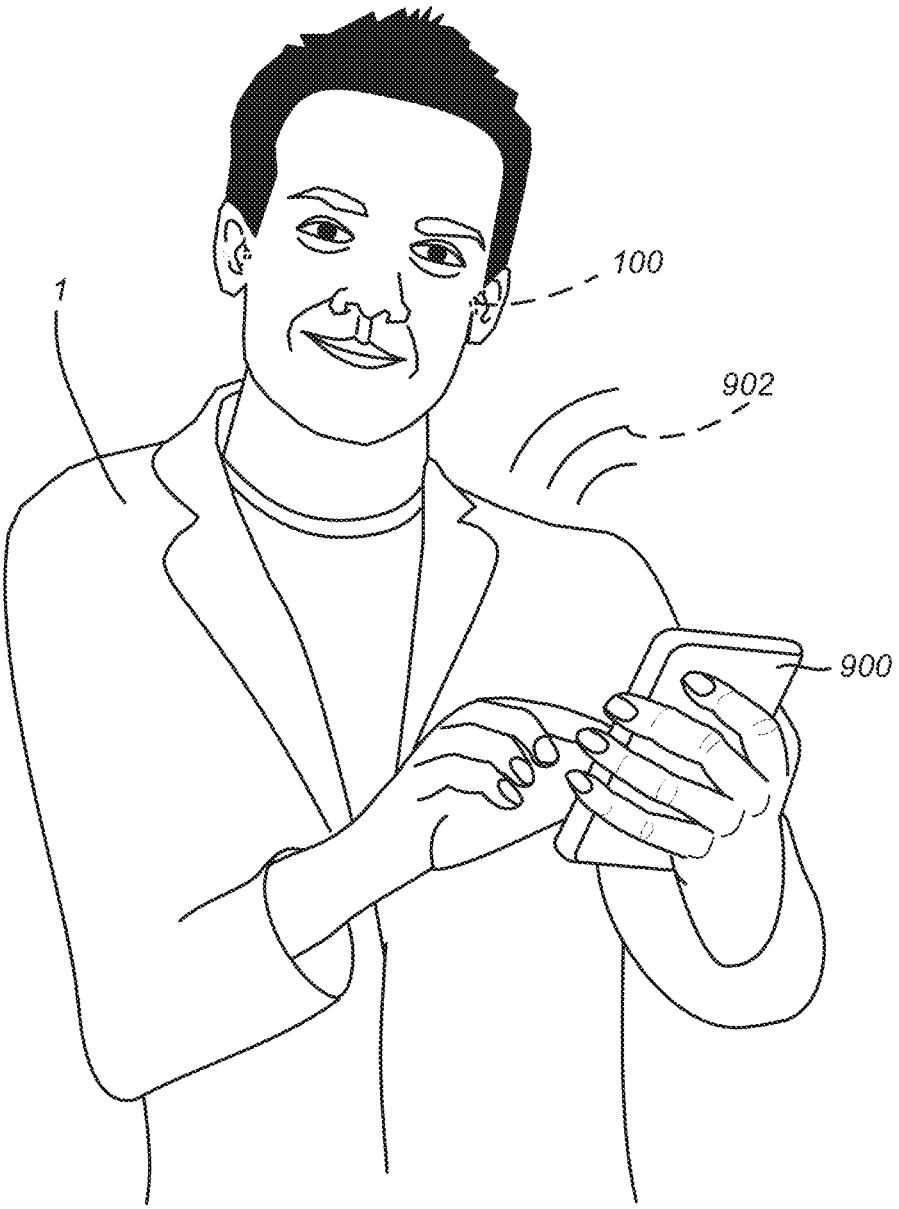
FIG. 10 is an illustration of a canal hearing device inserted in an ear canal of a user and in communication with a computing device, according to some examples.

FIGS. 10 & 12 are representations of a computing device in communication with a canal hearing device 100 configured to be worn in ear and hidden behind the tragus 3, according to some examples. The canal hearing device 100 may be communicatively coupled to the computing device 900 over a wireless interface. In some examples, the canal hearing device 100 may be programmable by the computing device 900, such as a personal computer, a smartphone, or a tablet. The computing device 900 may include memory 904 for storing control software application 910 for selecting or configuring appliance control parameters 130 and/or configuration data 132 of the canal hearing device 100. For example, the functionality of the switches 110-114 may be customized using the control software application 910. The control software application 910 may be executable by a processor 906 within the computing device 900 to send control signals 902 to the canal hearing device 100 for setting the appliance control parameters 130 of the canal hearing device 100. The control software application 910 may be configured to send and receive control signals 902 to and from the canal hearing device 100, such as the appliance control parameters 130, configuration data 132, and/or other status information of the canal hearing device 100.

In some examples, a binaural set of hearing devices may be configured differently and independently for the control of the same or multiple appliances. For example, a first canal hearing device of a binaural set may be configured for controlling a light and a second canal hearing device may be configured for controlling a television. One switch of the first canal hearing device may be configured for actuation of appliances (e.g., On/Off for a TV or lighting), while the switches of the second canal hearing device may be configured to change the settings of the appliances, for example changing the volume, channel, dimming, or other settings.

In some examples, the canal hearing device 100 may include telephony functionalities via wireless connectivity to a telephone. A first switch of the canal hearing device 100 may be manually activated to answer an incoming call. The canal hearing device 100 may transmit a telephone audio signal to the ear canal 10 of the user using the speaker 124 of the canal hearing device 100 in response to the activation of the switch to answer the phone call. A second or the same switch of the canal hearing device 100 may be manually activated to adjust the volume of the telephone audio signal in the ear upon taking the incoming call.

The canal hearing device 100 may store audio data 134 that may be played back using the sound processor 126 and speaker 124 of the canal hearing device 100 to alert the user to an incoming call or message. The alert may be a stored audio segment or may be provided to the canal hearing device 100 wirelessly during the incoming call, for example to include the name of the caller in the alert. The audio data 134 may include voice messages or voice memos. The audio data 134 may include text messages converted to audio messages, such as from e-mail, SMS, social media posts, and/or other text-based messages. The computing device 900, for example a smartphone, may provide the canal hearing device 100 with voice messages, voice memos, and/or text messages converted to audio messages. The canal hearing device 100 may include an interface for presenting stored audio data 134 to the user 1, such as by listing the stored messages and allowing the user 1 to scroll and select the one(s) they wish to play back using the switches 110-114.

In some examples, the appliance 800 may be a medical device. The canal hearing device 100 may detect the presence of the medical device. Upon detection of the medical device or by a command from the medical device, the canal hearing device 100 may transmit an audio signal (also referred to herein as audible signal) to the ear canal 10 of the user 1. The canal hearing device 100 may receive alerts related to a medical or health event from the medical device. The canal hearing device 100 may present the alert to the user 1 by transmitting an audio signal to the ear canal 10 of the user 1. In response to a manual activation of a switch of the canal hearing device 100, the canal hearing device 100 may transmit a wireless signal to the medical device for acknowledgment, control or verification. For example, the canal hearing device 100 may communicate wirelessly with an electronic medicine dispenser bottle (referred to herein as "e-dispenser") housing one or more medications (pills, for example) and provide an audible signal as a reminder for the user 1 to take any of the medications upon a wireless request from the c-dispenser. The user 1 may disable or terminate the repeating audio messages by activating a switch on the canal hearing device 100 which may also trigger a wireless confirmation signal to the e-dispenser.

The e-dispenser, through its processor, may perform a verification of taking the medication, for example by ensuring that the user 1 actually accessed a repository (e.g., opened a bottle cap) of the e-dispenser during an appropriate time frame. The verification may be initiated by transmitting a wireless confirmation signal to the canal hearing device 100. In some examples, the e-dispenser may include sensors to detect if the medication has been removed from the repository. If verification is negative, the e-dispenser may continue to request the canal hearing device 100 to generate an audible reminder signal through the speaker 124 of the canal hearing device 100. The audible reminder signal may be continuous or periodic. If the verification is positive, the canal hearing device 100 may terminate the audible reminder.

The computing device 900 may wirelessly transmit control signals 902 to set appliance control parameters 130 of the canal hearing device. The control parameter 130 may define a set of remote control functions and settings of a medical device (e.g., medical device 850). The canal hearing device 100 may use the appliance control parameters 130 to transmit appropriate wireless signals 802 to the medical device to perform the remote control functions. In this manner, the user 1 may control a medical device without direct physical contact with the medical device nor the use of an external device. This may be particularly advantageous for performing functions of a relatively inaccessible medical device, for example an implanted device or a medical device that is hard to reach.

In some examples, the canal hearing device 100 may detect the presence of the medical device. Upon detection of the medical device, the canal hearing device 100 may transmit an audio signal 120 to the ear canal 10 of the user 1. The canal hearing device 100 may wirelessly receive alerts related to medical or health events from the medical device. The canal hearing device 100 may present the alerts to the user 1 by transmitting an audio signal 120 to the ear canal 10 of the user 1. In response to a manual activation of a switch of the canal hearing device 100 may trigger the canal hearing device 100 to transmit a wireless signal 802 to the medical device for acknowledgment, control or verification.

In some examples, the canal hearing device 100 may be configured for verification of a medical request, such as consuming a medication from an electronic dispensing bottle 850 (FIG. 11). In some examples, the canal hearing device 100 may transmit and/or receive wireless signals 851 to and from an electronic dispensing bottle 850. For example, the canal hearing device 100 may receive a wireless signal 851 from the electronic dispensing bottle 850 to initiate an alert. The alert may be an audible signal 120 transmitted by the speaker of the canal hearing device 100 in the ear canal 10 of the user 1. In some examples, the alert may include a periodic transmission of the audible signal 120 to the ear canal 10 of the user 1. The user 1 may terminate the transmission of the alert by manual activation of a switch of the canal hearing device 100. The medical device or the canal hearing device may transmit a verification signal. If verification fails, the canal hearing device 100 may resume transmission of the alert until the user 1 properly complies with the medical request.

The medical device may perform a verification in response to the manual activation of the switch of the canal hearing device 100. It may be advantageous to perform the verification to ensure that the user 1 has performed a task related to the medical request. In some examples, manual activation of the switch may terminate the transmission of the alert. Continuing with the example of electronic dispensing bottle 850, the canal hearing device 100 may request a verification signal to the electronic dispensing bottle. If the verification fails, the canal hearing device 100 may resume transmission of the alert until the user 1 properly complies with taking the medication.

In some examples, the canal hearing device 100 may incorporate physiologic sensors 119 within. The physiologic sensors 119 may include, but are not limited to, any of electrodes, a temperature sensor, oxygen sensor, accelerometer, gyroscope, and a glucose meter. It will be understood that a variety of physiologic and motion sensors may be included in the canal hearing device 100. Incorporating the physiological sensors 119 within the canal hearing device 100 may be advantageous because the ear canal 10 is tethered to the human body during activity, for example walking or exercise, and the physiology of the ear canal 10 includes capillaries suited to measure certain physiological parameters such as heart rate. Additionally, blood to the ear canal 10 is usually supplied by the branches of the common carotid artery, which contributes directly to the perfusion of the brain. Thus, placing the physiological sensors 119 in the canal hearing device 100 may allow for more reliable physiological measurements because the ear canal 10 may be less affected by movement, temperature changes, and other sources of variability that are experienced by the periphery of the body. Further, a processor within the canal hearing device 100 may execute software to mitigate noise due to motion artifacts (e.g., walking or chewing).

In some examples, electrodes may be provided on the housing of the canal hearing device 100 to detect the heart rate of the user 1. In some examples, a thermometer may be provided in the canal hearing device 100 to detect the temperature of the user 1. In some examples, a glucose meter may be provided in the canal hearing device 100 to detect a blood glucose level of the user 1. In some examples, optical sensors may be provided on an external surface of the canal hearing device 100 to provide and receive reflected light to provide information on blood flow through the nearby tissue. Any of the physiological sensors may be provided on a medial or lateral portion 102 of the canal hearing device 100. Data received from the physiological sensors (also referred to as sensor data) may be analyzed to calculate and/or determine health parameters, such as calories burned.

The canal hearing device 100, through the processor within, may automatically detect the presence of a medical appliance, or a health condition, to transmit an appropriate audio signal 120, which may be in the form of a message through the speaker within. Thus, an appropriate wireless remote control signal corresponding to the specific medical appliance detected within proximity may be transmitted. In some examples, the actuation or control of the medical appliance is automatic, thereby not requiring an activation of a switch. For example, when sensors within the canal hearing device 100 detect a medical condition such as low temperature or high heart rate, the canal hearing device 100 may transmit an appropriate wireless signal 802 to address the medical condition. The appropriate wireless signal 802 may be determined using appliance control parameters 130 of the canal hearing device 100. The appliance control parameters 130 may include audible alerts to transmit based on the sensor readings. In some examples, the canal hearing device 100 may measure low blood sugar using the physiological sensors (e.g., a glucose meter) and send a remote control signal to an insulin pump to deliver insulin to the bloodstream of the user. The amount of insulin delivered by the insulin pump may be based on the level of blood sugar measured by the physiological sensors.

In some examples, the canal hearing device 100 is configured as an alert initiator during a medical condition or an emergency, such as a fall or a heart attack. In some examples, a fall may be detected using an accelerometer and/or a gyroscope within the canal hearing device 100. In some examples, a heart attack may be detected using a heart rate sensor within the canal hearing device 100. Appliance control parameters 130 of the canal hearing device 130 may be used to determine that a medical condition or an emergency has occurred. The appliance control parameters 130 may include one or more patterns of various medical conditions and/or emergencies, such as abnormal heart rate or gyroscope readings associated with a fall or inactivity. The canal hearing device 100 may determine that the medical emergency has occurred when the sensor readings match one or more of the patterns. The canal hearing device 100 may communicate with a remote medical alert service when the user 1 presses a switch on the lateral portion of the canal hearing device 100. In some examples, the switch may be pressed for a prolonged period, such as 2 or more seconds, indicating a medical emergency. A prolonged press may be advantageous to ensure that the switch is not being accidently pressed, or to differentiate from other remote control functions not associated with a medical emergency.

In some examples, the canal hearing device 100 may transmit an audio signal 120 to the ear canal 10 in response to detecting a medical condition or a medical emergency. The medical condition or medical emergency may be detected using one or more sensors of the canal hearing device 100. For example, an accelerometer and/or a gyroscope of the canal hearing device 100 may be used to determine that the user 1 has fallen. The canal hearing device 100 may transmit an audio signal 120 to the ear canal 10 in response to detecting the fall. The audio signal 120 may be a periodic alert. The user response may be a momentary activation of the switch or a prolonged activation of the switch.

By placing the canal hearing device 100 in the ear canal 10 such that the canal hearing device 100 extends laterally to the concha cavity 5 and behind the tragus 3, the canal hearing device 100 may be inconspicuously and securely worn. This may allow for minimal impact on the lifestyle of the user 1, for example, without substantially interfering with vigorous activity such as running, hunting, sports and exercising in general. Additionally, the switches of the canal hearing device 100 are accessible to the user 1 to actuate wireless signals to a variety of appliances, thereby allowing for control of other devices used and encountered in daily life.

In some examples, the canal hearing device 100 is waterproof allowing for showering and swimming while being worn. The inconspicuous wear of the canal hearing device 100 behind the tragus allows for discrete and private communications without altering others for any personal use. Existing Bluetooth-enabled hearing devices considerably extend laterally from the ear, compromising secure and inconspicuous wear.

Figure 14:
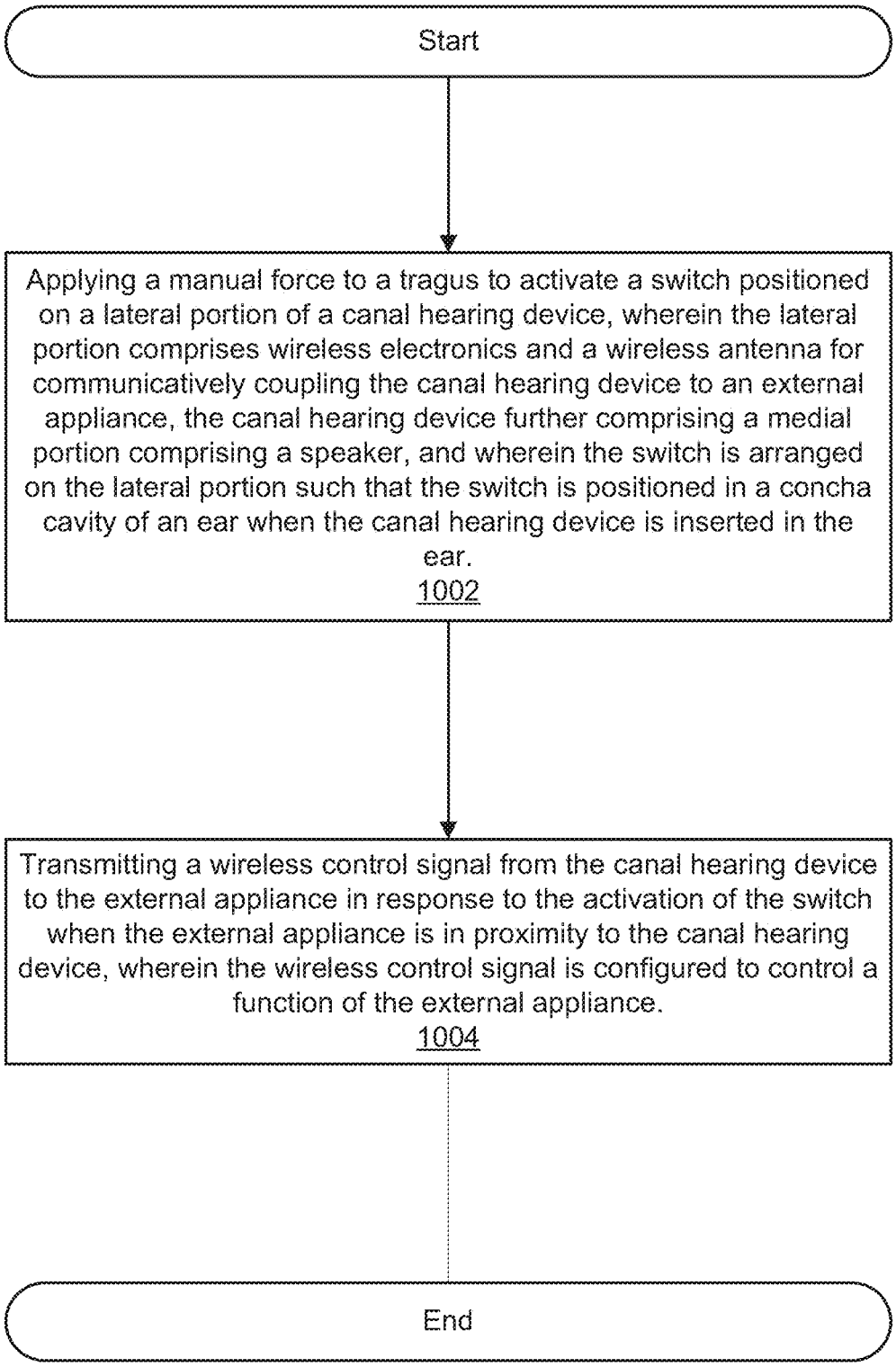
FIG. 14 is a flow chart of a method for control of an appliance by a canal hearing device, according to some examples.

FIG. 14 shows a flowchart for control of an appliance by a canal hearing device, according to some examples. While the various steps in this flowchart are presented and described sequentially, one of ordinary skill will appreciate that some or all of the steps can be executed in different orders and some or all of the steps can be executed in parallel. Further, in one or more embodiments, one or more of the steps described below can be omitted, repeated, and/or performed in a different order. Accordingly, the specific arrangement of steps shown in FIG. 14 should not be construed as limiting the scope of the invention.

In step 1002, a manual force may be applied to a tragus to activate a switch positioned on a lateral portion of a canal hearing device. The lateral portion may include wireless electronics for communicatively coupling the canal hearing device to an external appliance. The canal hearing device may include a medial portion including a speaker. The switch may be arranged on the lateral portion such that the switch is positioned in a concha cavity of an ear when the canal hearing device is inserted in the ear. In step 1004, a wireless control signal may be transmitted by the canal hearing device in response to the activation of the switch when the external appliance is in proximity to the canal hearing device. The wireless control signal may be configured to control a function of the external appliance. In some examples, the external appliance may include a medical device.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention may be limited only by the appended claims and the rules and principles of applicable law.

What is claimed is:

1. A wireless hearing device comprising:

a speaker configured for placement in an ear of a user;

memory configured to receive, from a computing device, and store a plurality of control parameters which determine a manner in which the wireless hearing device wirelessly controls any one of a plurality of appliances when in proximity to the wireless hearing device;

wireless electronics configured to communicatively couple the wireless hearing device to an appliance from the plurality of appliances when the appliance is detected in proximity to the wireless hearing device; and a processor configured to detect the appliance in proximity, determine a relative movement of the wireless hearing device relative to the appliance in proximity and/or a reference frame, and cause the wireless electronics to wirelessly transmit, to the appliance in proximity, a control signal that controls a function of the appliance in proximity, wherein the control signal is based on one or more of the control parameters retrieved from memory and corresponding to the appliance in proximity, and further based on at least one of a status of the appliance in proximity and the relative movement, and wherein the wireless hearing device is configured to automatically scan for and detect the appliance in proximity when the wireless hearing device is in scanning mode.

2. The wireless hearing device of claim 1, further comprising one or more sensors configured to generate motion data for determining the relative movement.

3. The wireless hearing device of claim 2, wherein the one or more sensors include an accelerometer, a gyroscope, a proximity sensor, or a combination thereof.

4. The wireless hearing device of claim 1, further comprising a switch configured, when actuated, to trigger a wireless transmission between the wireless hearing device and the appliance in proximity.

5. The wireless hearing device of claim 4, wherein the switch is a touch switch.

6. The wireless hearing device of claim 4, wherein the appliance in proximity is an electronic lock.

7. The wireless hearing device of claim 1, further comprising a wireless antenna.

8. The wireless hearing device of claim 1, further comprising one of more sensors configured to sense any of heart rate, heart condition, temperature, activity, motion, blood pressure or glucose level of the user.

9. The wireless hearing device of claim 1, wherein the computing device is a smartphone.

10. The wireless hearing device of claim 1, wherein the wireless electronics are configured to wirelessly transmit one or more signals for at least one of requesting the status of the appliance in proximity and changing the status of the appliance in proximity.

11. The wireless hearing device of claim 1, wherein the one or more of the control parameters retrieved from memory and corresponding to the appliance in proximity configures the wireless hearing device to send, to the appliance in proximity, a first control signal when the relative movement is indicative of the wireless hearing device moving toward the appliance and a second control signal when the relative movement is indicative of the wireless hearing device moving away from the appliance.

12. The wireless hearing device of claim 1, wherein at least one of detecting the appliance in proximity, determining of the relative movement, determining the status of the appliance in proximity, and the wireless transmission of the control signal occur in response to activation of a switch of the wireless hearing device.

13. The wireless hearing device of claim 1, wherein the wireless hearing device comprises a binaural hearing device including a left hearing device and a right hearing device, the left hearing device configured to store a first subset of the plurality of control parameters and to wirelessly control a first appliance detected in proximity in accordance with the first subset of the plurality of control parameters, and the right hearing device configured to store a second subset of the plurality of control parameters and to wirelessly control a second different appliance detected in proximity in accordance with the second subset of the plurality of control parameters.

14. A method of remote control of an appliance by a wireless hearing device, comprising:

receiving, from a computing device communicatively coupled to a wireless hearing device, a plurality of control parameters that configure the wireless hearing device to remotely control each of a plurality of appliances when in proximity to the wireless hearing device, wherein the wireless hearing device comprises a speaker configured for placement in an ear of a user;

storing the plurality of control parameters in memory of the wireless hearing device;

detecting, by the wireless hearing device, one of the plurality of appliances in proximity to the wireless hearing device; and transmitting, by the wireless hearing device, a control signal configured to control a function of the appliance in proximity according to the control parameter selected from memory to correspond to the appliance detected in proximity, wherein the control signal is based, at least in part, on at least one of a status of the appliance and relative movement between the wireless hearing device and the application and/or a reference frame, wherein the wireless hearing device is configured to automatically detect any of the plurality of appliances when in proximity to the wireless hearing device and generate an audible sound when the one of the plurality of appliances has been detected in proximity.

15. The method of claim 14, wherein the wireless hearing device comprises a switch, and wherein at least one of said detecting and transmitting occurs responsive to actuation of the switch.

16. The method of claim 14, wherein the transmitting comprises transmitting a first control signal when the relative movement indicates that the wireless hearing device is moving toward the appliance and transmitting a second control signals when the relative movement indicates that the wireless hearing device is moving away from the appliance.

17. The method of claim 16, further comprising determining, by the wireless hearing device, the relative movement.

18. The method of claim 17, wherein the wireless hearing device further comprises at least one sensor configured to generate motion data, and wherein said determining the relative movement is based, at least in part, on the motion data.

19. A wireless hearing device comprising:

a speaker configured for placement in an ear of a user;

memory configured to receive, from a smart phone, and store a plurality of control parameters which determine a manner in which the wireless hearing device wirelessly controls any one of a plurality of appliances when in proximity to the wireless hearing device;

wireless electronics configured to communicatively couple the wireless hearing device to an appliance from the plurality of appliances when the appliance is detected in proximity to the wireless hearing device; and a processor configured to detect the appliance in proximity, determine a relative movement of the wireless hearing device relative to the appliance in proximity and/or a reference frame, and cause the wireless electronics to wirelessly transmit, to the appliance in proximity, a control signal that controls a function of the appliance in proximity, wherein the control signal is based on one or more of the control parameters retrieved from memory and corresponding to the appliance in proximity, and further based on at least one of: a status of the appliance in proximity and the relative movement.

20. The wireless hearing device of claim 19, further comprising one of more sensors configured to sense any of heart rate, heart condition, temperature, activity, motion, blood pressure or glucose level of the user.

21. The wireless hearing device of claim 19, wherein the wireless hearing device comprises a binaural hearing device including a left hearing device and a right hearing device, the left hearing device configured to store a first subset of the plurality of control parameters and to wirelessly control a first appliance detected in proximity in accordance with the first subset of the plurality of control parameters, and the right hearing device configured to store a second subset of the plurality of control parameters and to wirelessly control a second different appliance detected in proximity in accordance with the second subset of the plurality of control parameters.

* * * * *